US010618238B2

(12) United States Patent
Sashida et al.

(10) Patent No.: US 10,618,238 B2
(45) Date of Patent: Apr. 14, 2020

(54) METAL SCRAP COMPRESSOR

(71) Applicant: YUKEN KOGYO CO., LTD., Ayase-shi, Kanagawa (JP)

(72) Inventors: Takashi Sashida, Tokyo (JP); Kiyoto Koganei, Fujisawa (JP)

(73) Assignee: YUKEN KOGYO CO., LTD., Ayase-Shi, Kanagawa (JP)

( * ) Notice: Subject to any disclaimer, the term of this patent is extended or adjusted under 35 U.S.C. 154(b) by 241 days.

(21) Appl. No.: 15/735,001

(22) PCT Filed: Jun. 10, 2016

(86) PCT No.: PCT/JP2016/067367
§ 371 (c)(1),
(2) Date: Dec. 8, 2017

(87) PCT Pub. No.: WO2016/199889
PCT Pub. Date: Dec. 15, 2016

(65) Prior Publication Data

US 2018/0147805 A1 May 31, 2018

(30) Foreign Application Priority Data

Jun. 11, 2015 (JP) ..... 2015-118208

(51) Int. Cl.
*B30B 1/32* (2006.01)
*B30B 15/02* (2006.01)
*B30B 9/32* (2006.01)

(52) U.S. Cl.
CPC ..... *B30B 15/026* (2013.01); *B30B 1/32* (2013.01); *B30B 9/32* (2013.01)

(58) Field of Classification Search
CPC ..... B30B 9/32; B30B 9/327; B30B 9/328; B30B 9/3078; B30B 9/3014; B30B 9/067;
(Continued)

(56) References Cited

U.S. PATENT DOCUMENTS 2,984,172 A * 5/1961 Roberts ..... B65B 27/12 100/90
3,089,410 A * 5/1963 Stangl ..... B30B 7/04 100/215

(Continued)

FOREIGN PATENT DOCUMENTS

CN 1964840 A 5/2007
CN 201922567 U 8/2011

(Continued)

OTHER PUBLICATIONS

China Patent Office, "Office Action for Chinese Patent Application No. 201680033482.8," dated Feb. 22, 2019.

(Continued)

*Primary Examiner* — Jimmy T Nguyen
(74) *Attorney, Agent, or Firm* — Manabu Kanesaka

(57) ABSTRACT

A metal scrap compressor obviates cut scraps accumulation potentially causing malfunction of a press cylinder device. In a metal scrap compressor, a press cylinder device includes: a pair of wall-like side blocks disposed between a cylinder flange at an end of a cylinder tube and a base on a base stand so as to form a frame structure; and a cup-shaped block member removably mounted on the base as disposed between these side blocks and containing therein a pressure forming chamber. The block member includes a charging opening for metal scraps, allows a press ram replaceably mounted to a distal end of a piston rod of the press cylinder device to be reciprocally slidably inserted therein through a ceiling thereof, and includes therein a press forming die replaceably mounted to a distal end of the press ram and reciprocally moved in the pressure forming chamber.

4 Claims, 3 Drawing Sheets

(58) Field of Classification Search
CPC ..... B30B 1/32; B30B 11/02; B30B 11/025; B30B 11/225; B30B 15/026; B30B 15/022; B30B 15/32; B28B 3/02; B28B 13/02; B28B 13/04; B28B 13/00; B28B 13/06
USPC ..... 100/902
See application file for complete search history.

(56) References Cited

U.S. PATENT DOCUMENTS

| | | | | | |
|---|---|---|---|---|---|
| 5,203,261 | A * | 4/1993 | Davis | B30B 9/3078 | 100/215 |
| 5,391,069 | A * | 2/1995 | Bendzick | B30B 9/04 | 100/116 |
| 5,983,788 | A * | 11/1999 | Wernimont | B30B 9/3039 | 100/125 |
| 7,628,602 | B2 * | 12/2009 | Matsuda | B30B 9/327 | 425/256 |
| 2008/0196605 | A1 | 8/2008 | Matsuda | | |

FOREIGN PATENT DOCUMENTS

| | | | |
|---|---|---|---|
| CN | 203210736 | U | 9/2013 |
| CN | 203697504 | U | 7/2014 |
| CN | 203792741 | U | 8/2014 |
| CN | 203919781 | U | 11/2014 |
| CN | 204054743 | U | 12/2014 |
| CN | 204296073 | U | 4/2015 |
| JP | H09-174299 | A | 7/1997 |
| JP | H09-239594 | A | 9/1997 |
| JP | 2955981 | B2 | 10/1999 |
| JP | 2001-300783 | A | 10/2001 |
| TW | M303817 | U | 1/2007 |
| TW | 201350221 | A | 12/2013 |
| WO | 2005/120818 | A1 | 12/2005 |

OTHER PUBLICATIONS

Korea Patent Office, "Office Action for Korean Patent Application No. 10-2017-7034216," dated May 19, 2019.
PCT/IB/338, "Notification of Transmittal of Translation of the International Preliminary Report on Patentability for International Application No. PCT/JP2016/067367," dated Dec. 21, 2017.
PCT/IB/373, "International Preliminary Report on Patentability for International Application No. PCT/JP2016/067367," dated Dec. 12, 2017.
PCT/ISA/237, "Written Opinion of the International Searching Authority for International Application No. PCT/JP2016/067367," dated Sep. 6, 2016.
PCT/ISA/210, "International Search Report for International Application No. PCT/JP2016/067367," dated Sep. 6, 2016.
Japan Patent Office, "Office Action for Japanese Patent Application No. 2015-118208," dated May 18, 2016.
Japan Patent Office, "Decision to Grant for Japanese Patent Application No. 2015-118208," dated Oct. 19, 2016.
Taiwan Patent Office, "Office Action for Taiwanese Patent Application No. 105118256," dated Aug. 21, 2017.
Taiwan Patent Office, "Office Action for Taiwanese Patent Application No. 105118256," dated Nov. 23, 2017.

* cited by examiner

METAL SCRAP COMPRESSOR

RELATED APPLICATIONS

The present application is National Phase of International Application No. PCT/JP2016/067367 filed Jun. 10, 2016, and claims priority from Japanese Application No. 2015-118208, filed Jun. 11, 2015, the disclosure of which is hereby incorporated by reference herein in its entirety.

TECHNICAL FIELD

The present invention relates to a metal scrap compressor for compressing metal scraps resulting from metal cutting work, for example, into a mass of a predetermined shape. More particularly, the invention relates to a partial structure of a press cylinder device.

BACKGROUND ART

The metal cutting work by a machine tool produces a large volume of metal scraps, which are useful enough to be recovered for recycling. However, the metal scraps resulting from the cutting work have a variety of shapes and sizes, such as of ribbons, spirals, coils, volutes, frizz, curls, and scraps. It is cumbersome to handle such metal scraps as they are. Hence, the metal scraps are compacted into a mass of a predetermined shape by means of a compressor.

Such a metal scrap compressor generally has a structure where the metal scraps are fed into a hopper, which delivers the metal scraps to a pressure forming chamber in which the metal scraps are compression formed by a press cylinder device driven by a hydraulic pump motor unit, and where a formed article resulting from the pressure forming is discharged to the outside of the forming chamber by driving a discharge cylinder device.

It is noted, however, that the metal scraps vary in shape and size as well as in bulk density. In the case of curled metal scraps having low bulk density, for example, the metal scraps need be subjected to adjustment before pressure forming. In this connection, there is known a metal scrap compressor in which the hopper incorporates therein a shredder for finely shredding the metal scraps before delivery to the forming chamber (see, Patent Literature 1). Some metal scrap compressor may further include a mixer for preventing the degradation of work efficiency due to bridge-like accumulation of the metal scraps above there. Further, a vertical-type compressor which has a press cylinder device vertically driven is predominant because the vertical-type compressor requires less area for installation than a horizontal-type compressor which has a press cylinder device horizontally or laterally driven.

Specific operations of such a metal scrap compressor are as illustrated in fragmentary sectional views of FIGS. 2A to 2D. When the compressor is automatically started in response to a command from a controller 30, a charging step is first started. A motor M drives a screw conveyor C to rotate so that metal scraps 50 stored in a hopper 6 are charged in a pressure forming chamber 25 through a charging opening F, as being finely shredded. The charging opening is formed at an upper part of one lateral side of the pressure forming chamber. In this step, as shown in FIG. 2A, a discharge gate 12 is closed with a distal end of a discharge plunger 11 of a gate cylinder device 10 horizontally driven. The discharge gate is disposed at a lower end of the other lateral side of the pressure forming chamber 25 and is communicated with a discharge port 13 for discharging the formed article after compression forming.

Subsequently, the pressure forming step is started. The controller controls the drive of working oil pressure for a press cylinder device 20 via the hydraulic power unit. A press ram 24 at a distal end of a piston rod 23 is lowered in the pressure forming chamber 25 so that the metal scraps 50 charged therein are pressure formed into a mass. As shown in FIG. 2B, in a state in which the plunger so extended on a bottom of the pressure forming chamber as to close the discharge gate 12 with the distal end thereof, the pressure forming step is performed on the discharge plunger 11 of the gate cylinder device 10.

After the pressure forming of the metal scraps, a discharging step is started. The controller controls the drive of working oil pressure via a hydraulic power unit so that an opening operation of the gate cylinder device 10 is started so move back the discharge plunger 11. When the discharge plunger 11 is moved back to place the gate cylinder device 10 in an open state, the drive of the gate cylinder device 10 is disabled. At this time, a formed article 51 is allowed to fall to a bottom of the pressure forming chamber 25.

Subsequently, the press cylinder device 2 is driven again so that the piston rod 23 and the press ram 24 are lowered to apply final pressing to the formed article 51 fallen to the bottom, as shown in FIG. 2C. Thus, the formed article 51 is further compressed to such a thickness as to pass through the discharge gate 12 smoothly.

When the final pressing of the metal chip mass is completed, the piston rod 23 of the press cylinder device 20 is elevated together with the press ram 24. Subsequently, the gate cylinder device 10 is driven to move the discharge plunger forward. At the time when the discharge plunger 11 is moved forward to bring the distal end thereof to a position to close the discharge gate 12, the formed article 51 is discharged through the discharge gate 12 to the outside of the pressure forming chamber 25 (to the discharge port 13), as shown in FIG. 2D. The drive of the gate cylinder device 10 is disabled to complete the discharging step.

As just described, when the discharge of the formed article 51 and the return of the press cylinder device 20 are completed, the operation can proceed to the next charging step. Thereafter, the cycle of the process from the charging step to the discharging step through the pressure forming step is repeated. Since the formed articles 51 are continuously discharged to the discharge port 13 side by the repeated cycles, the preceding formed article 51 is extruded by the subsequent formed article 51 so that the formed articles discharged to the outside of the compressor successively.

In the conventional metal scrap compressor performing the above-described operations, the largest drive mechanism is the press cylinder device. A conventional structure of this press cylinder device is shown in FIG. 3. An end of a cylinder tube 21 is fixed to a cylinder flange 22. A hollow block 28 is interposed between the cylinder flange and a base 14 a top side of which includes a bottom surface of the pressure forming chamber 25. The cylinder flange and the base are coupled together by a tie rod 27. A piston rod 23 and a press ram 24 fixed thereto are moved up and down in this block 28. The metal scraps charged in the pressure forming chamber 25 disposed in a lower part of the block 28 are pressure formed by a die 26 replaceably mounted to a distal end of the press ram 24.

CITATION LIST

Patent Literature

Patent Literature 1: Japanese Patent Application Laid-Open No. 2955981

SUMMARY OF INVENTION

Technical Problem

In the press cylinder device of the metal scrap compressor which has the above-described configuration, the die is a consumable article that is replaced with new one as needed. To replace the die, however, the block must be disassembled from the cylinder flange. This requires that the tie rod clamping down the block to be unfastened.

In the existing metal scrap compressor, the tie rod is fastened with an axial force of no less than 11 tons, for example. Each time the die is replaced, the unfastening of the tie rod takes lots of hard work. Furthermore, the replacement of the die involves quite an extensive work in which an overhead traveling crane and a forklift are used for disassembling the press cylinder device and removing heavy-weight members including the tie rod and block spanning such a great length from the cylinder flange to the base.

In the structure of the conventional press cylinder device, a part between the cylinder flange and the base, namely the whole body of a drive portion outside the cylinder tube is enclosed by the block. Hence, cut scraps adhered to peripheries of the piston rod and press ram are accumulated, causing malfunction.

In view of the above-described problems, an object of the invention is to provide a metal scrap compressor featuring a press cylinder device which offers an easier replacement work of the pressure forming die than before and which is configured to obviate the accumulation of cut scraps that can potentially cause malfunction.

Solution to Problem

According to a first aspect of the invention for achieving the above object, a metal scrap compressor includes on a base stand: a hopper supplied with metal scraps; a pressure forming chamber which stores the metal scraps fed from the hopper; a press cylinder device for pressure forming the metal scraps charged in the pressure forming chamber; a gate cylinder device for pushing and discharging a formed article to the outside of the pressure forming chamber after the pressure forming; and a controller for controlling the drive of working fluid pressure for the press cylinder device and the gate cylinder device, and has a structure wherein the press cylinder device includes: a pair of wall-like side blocks which form a frame structure as disposed in mutually opposed relation between a cylinder flange at an end of a cylinder tube and a base on a base stand; and a cup-shaped block member removably mounted on the base as disposed between these side blocks and containing therein the pressure forming chamber, and the block member includes a charging opening for receiving the metal scraps fed from the hopper, allows a press ram replaceably mounted to a distal end of a piston rod of the press cylinder device to be reciprocally slidably inserted therethrough via a ceiling thereof, and includes therein a press forming die replaceably mounted to a distal end of the press ram and reciprocally moved in the pressure forming chamber.

Advantageous Effects of Invention

The metal scrap compressor according to the invention features the structure wherein a pair of wall-like side blocks form a frame structure as disposed in mutually opposed relation between the cylinder flange at an end of the cylinder tube and the base on the base stand; the cup-shaped block member containing therein the pressure forming chamber is disposed inside the frame structure and removably mounted on the base; the press ram replaceably mounted to the distal end of the piston rod is reciprocally slidably inserted through the ceiling of the block member so as to reciprocally move the pressure forming die at the distal end of the piston ram in the pressure forming chamber. This structure has an advantage that when the die is replaced, the replacement work is easily accomplished simply by lifting up the block member alone, negating the need for removing the side blocks. Further, the space above the block member is not closed and hence, also the fear that the accumulation of cut scraps may cause the malfunction of the press cylinder device is eliminated.

BRIEF DESCRIPTION. OF DRAWINGS

DESCRIPTION OF EMBODIMENTS

A metal scrap compressor according to the invention features a press cylinder device in which: a frame structure is formed by a pair of wall-like side blocks disposed in mutually opposed relation between a cylinder flange at an end of a cylinder tube and a base on a base stand; a cup-shaped block member is disposed between the pair of side blocks or inside the frame structure and is removably mounted on the base; a press ram fixed to a distal end of a piston rod is reciprocally slidably inserted in the block member through a ceiling thereof; and a pressure forming die replaceably mounted to a distal end of the press ram is reciprocally moved in a pressure forming chamber inside the block member. According to the invention, therefore, in space between the cylinder flange and the base of the press cylinder device, only the periphery of the pressure forming chamber is substantially covered by the block member. In this configuration, there is no fixing member that closes a space above the block member. In the replacement of the die, therefore, the removal of the die is enabled simply by lifting up the block member alone, negating the need for the removal of other members such as the side blocks.

This eliminates the need for the extensive work using the overhead traveling crane, forklift and the like. The die replacement work becomes much simpler than the conventional work where the block entirely covering the space between the cylinder flange and the base is removed by unfastening the tie rods. Further, the space above the block member is not closed so that a fear of the cut scraps being accumulated and causing the malfunction of the press cylinder device is eliminated.

A method of mounting the block member on the base can employ any one of various mechanisms that can removably fix the block member in state as it is placed on the base. However, it is more desirable to employ a simpler mechanism. An example of the desirable mechanism is a configuration where the block member is fastened to the base by means of the tie rod vertically extending through the block member. In this case, a die replacement work is easy because what is to be done for replacing the die is simply to unfasten the tie rod having substantially the same height as the block member.

Embodiment

Figure 1A:
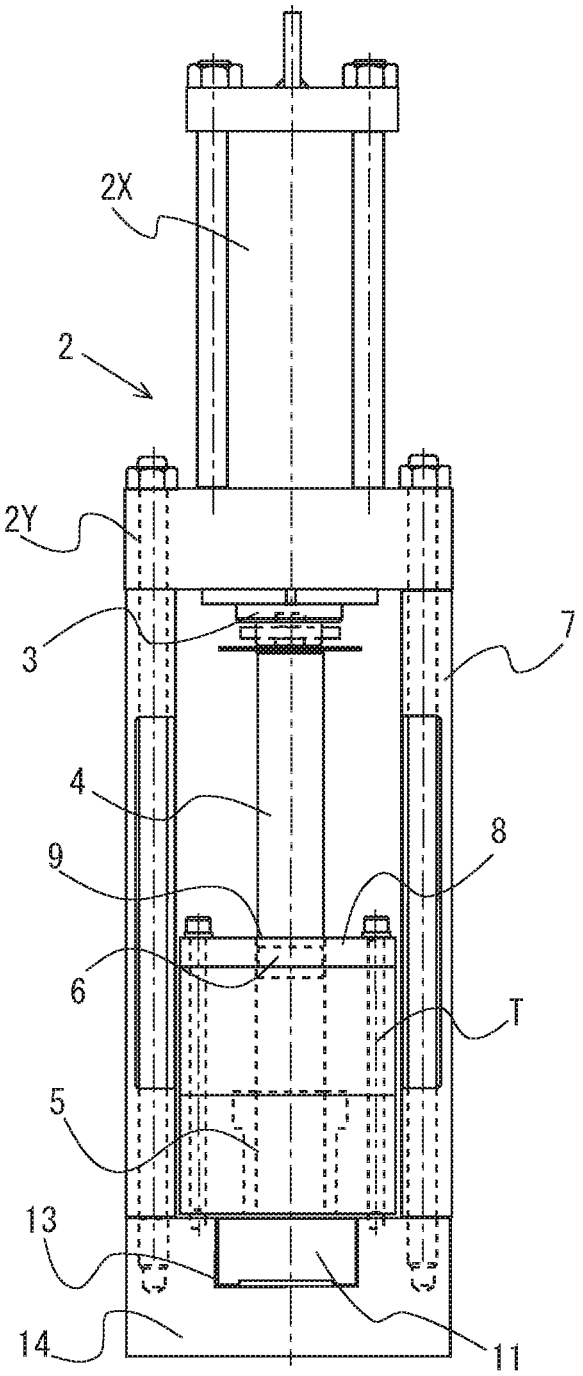
FIG. 1A and FIG. 1B are schematic fragmentary configuration diagrams showing a structure of a compression-side part of a press cylinder device of a metal scrap compressor according to one embodiment of the invention, FIG. 1A representing a front view thereof and FIG. 1B representing a side view thereof.
Figure 1B:
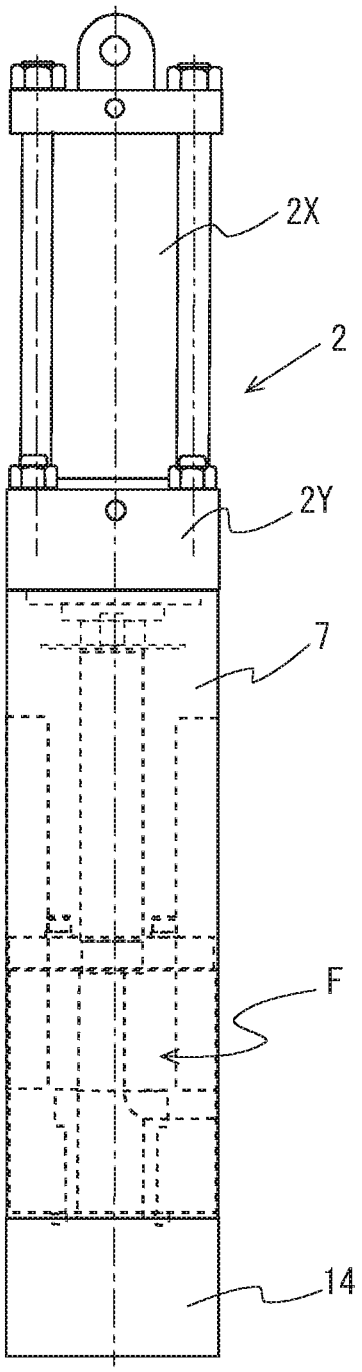
Figure 2A:
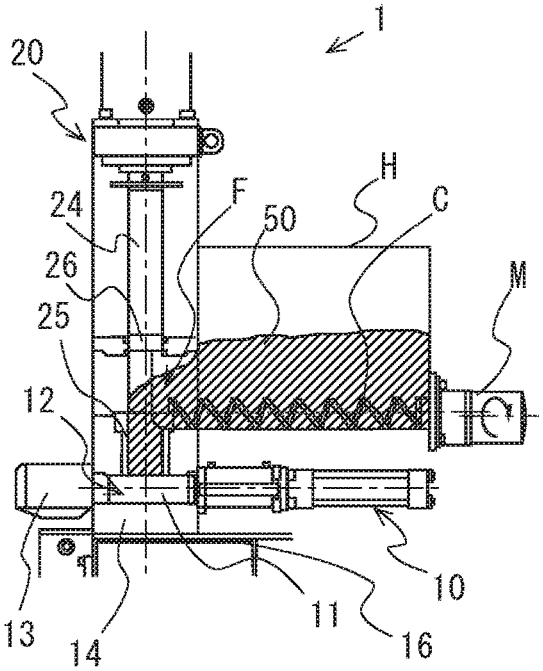
FIG. 2A, FIG. 2B, FIG. 2C and FIG. 2D are fragmentary sectional views for illustrating the operations of a conventional metal scrap compressor, FIG. 2A to FIG. 2D representing respective steps in sequence.
Figure 2C:
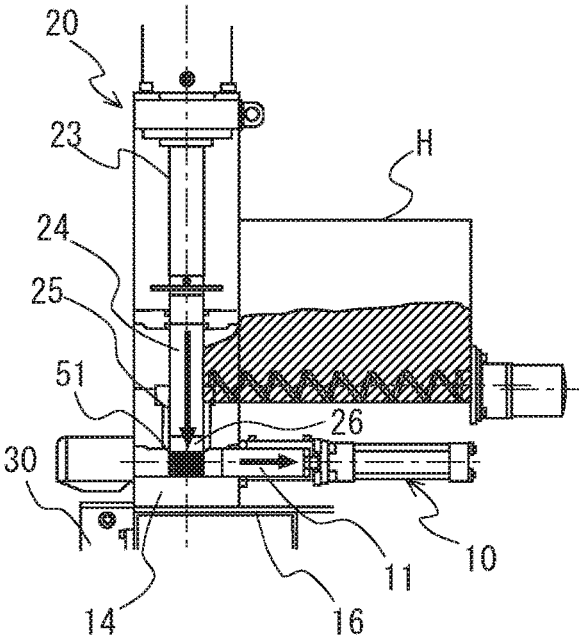
Figure 2B:
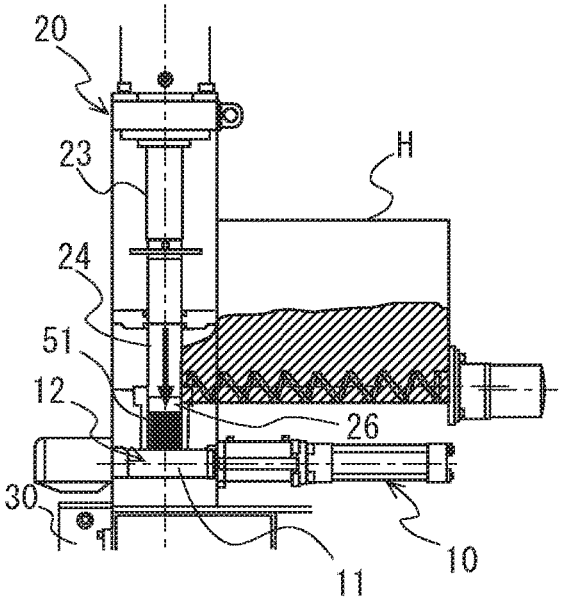
Figure 2D:
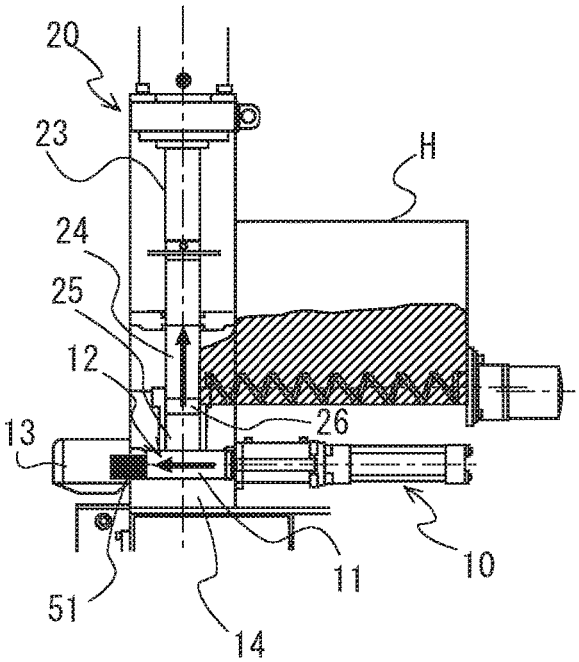
Figure 3:
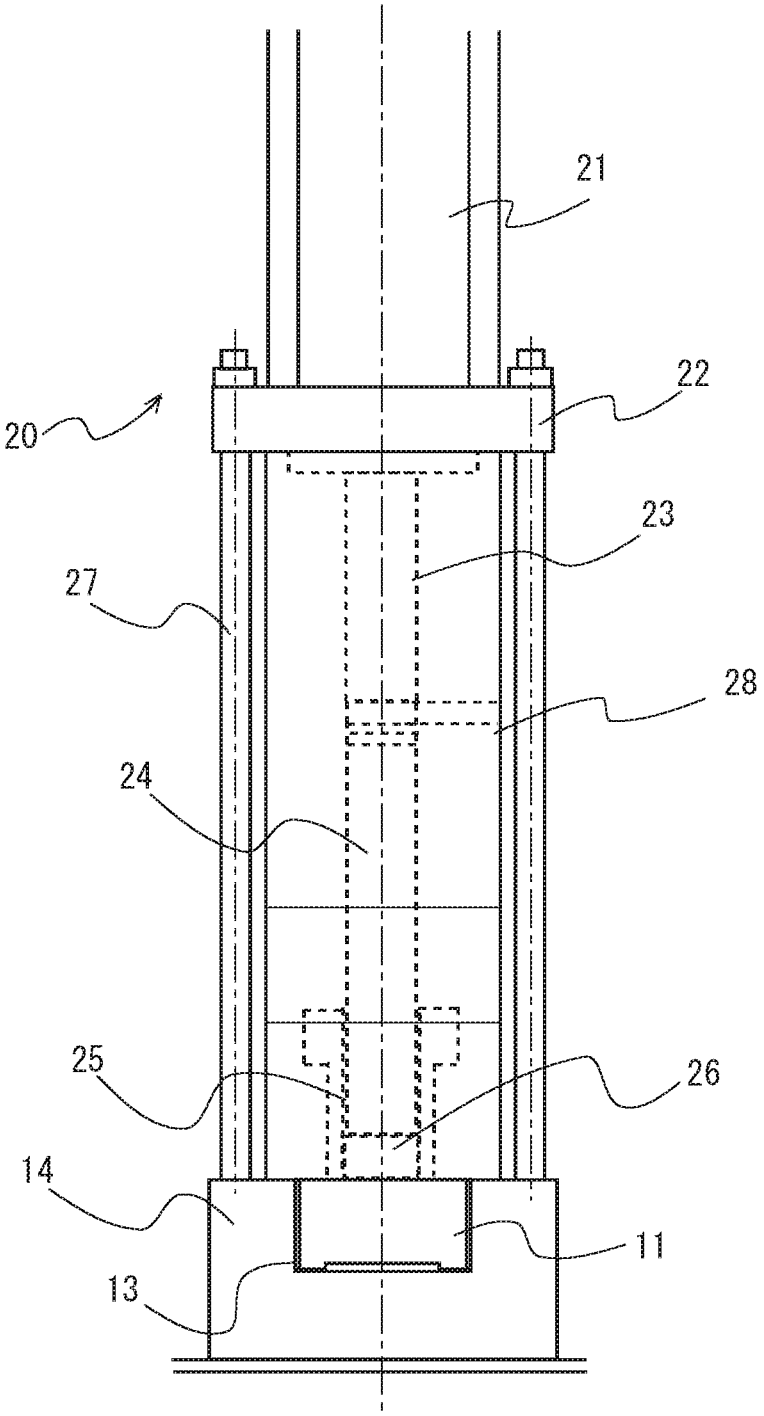
FIG. 3 Prior Art
FIG. 3 is a schematic fragmentary front view showing a structure of a compression-side part of a press cylinder device of the conventional metal scrap compressor.

A partial structure of a press cylinder device of a metal scrap compressor according to one embodiment of the invention is shown in FIG. 1A and FIG. 1B. FIGS. 1A and 1B are schematic fragmentary configuration diagrams showing a structure of a part of a press cylinder device 2, which is between a cylinder flange 2Y fixed to an end of a cylinder tube 2*x* and a base 14, FIG. 1A representing a front view thereof and FIG. 1B representing a side view thereof. An internal structure of a block member 8 is delineated by the dotted lines in the figures.

As shown in FIGS. 1A and 1B, the press cylinder device 2 according to the embodiment has a frame structure formed by a pair of wall-like side blocks 7 which are disposed on opposite sides of a space between the cylinder flange 2*y* and the base 14 and fixedly fastened in position by means of tie rods.

Inside this frame structure, the cup-shaped block member 8 is removably fastened and fixed directly onto the base 14 by means of tie rods T. This block member 8 defines therein a pressure forming chamber 5 which is formed with a charging opening F on a rear side thereof for receiving metal scraps delivered from a hopper (not shown).

Further, the block member 8 is formed with a through-hole 9 in a ceiling portion on a center axis thereof. A press ram 4 fixed to a distal end of a piston rod 3 is reciprocally slidably inserted in the block member via the through-hole 9. The press ram is adapted to move up and down in the pressure forming chamber 5 as driven by the press cylinder device 2.

A pressure forming die 6 replaceably mounted to a distal end of the press ram 4 is moved up and down along with the press ram 4 in the pressure forming chamber 5. In a pressure forming step, the press forming die is drivenly lowered so as to compress and pressure form the metal scraps charged in the pressure forming chamber 5 into a mass. At this time, the pressure forming step can be performed based on the same operating procedure as that of the conventional metal scrap compressor as shown in FIGS. 2A to 2D. Hence, drive control and the like for automatic operation need not be subjected to any change.

When the die 6 need be replaced after long-term use, the die replacement work can be easily accomplished simply by unfastening the short tie rods T to release the block member 8 from the base 14 and lifting up the block member. This negates the need for removing the side blocks 7. Further, deposition substance adversely affecting the drive of the press cylinder device 2 is not produced during the pressure forming step because the space above the block member 8 in the frame structure is open.

While the block member 8 is directly fixed onto the base 14 by means of the tie rods T in the above embodiment, the invention is not necessarily limited to this mounting method. For example, an adoptable configuration is made such that as placed on the base 14 at a predetermined position, the block member 8 has an upper part thereof releasably bolted to the side block 7 by means of connecting fittings or the like.

REFERENCE SIGNS LIST

1: Metal scrap compressor
2, 20: Press cylinder device
2X, 21: Cylinder tube
2Y, 22: Cylinder flange
3, 23: Piston rod
4, 24: Press ram
5, 25: Pressure forming chamber
6, 26: Die
7: Side block
8: Block member
T: Tie rod
9: Through-hole
10: Gate cylinder device
11: Discharge plunger
12: Discharge gate
13: Discharge port
14: Base
16: Base stand
F: Charging opening
H: Hopper
M: Motor
C: Screw conveyor
27: Tie rod
28: Block

The invention claimed is:

1. A metal scrap compressor comprising on a base stand:

a hopper supplied with metal scraps;

a pressure forming chamber which stores the metal scraps delivered from the hopper;

a press cylinder device for pressure-forming the metal scraps charged in the pressure forming chamber;

a gate cylinder device for pushing and discharging a formed article to an outside of the pressure forming chamber after pressure-forming the metal scraps; and a controller for controlling drive of working fluid pressure for the press cylinder device and the gate cylinder device, wherein the press cylinder device includes: a pair of wall side blocks which forms a frame structure as disposed in mutually opposed relation between a cylinder flange at an end of a cylinder tube and a base on the base stand; and a cup-shaped block member removably mounted on the base of the base stand as disposed between the pair of wall side blocks and containing therein the pressure forming chamber, the pressure forming chamber is arranged above a discharge plunger of the gate cylinder device, the gate cylinder device is configured so that the formed article which has been pressure-formed above the discharge plunger falls from the pressure forming chamber by moving back the discharge plunger, and then discharges the formed article by moving forward the discharge plunger, the block member includes a charging opening for receiving the metal scraps delivered from the hopper, allows a press ram replaceably mounted to a distal end of a piston rod of the press cylinder device to be reciprocally slidably inserted therein through a ceiling thereof, and stores therein a press forming die replaceably mounted to a distal end of the press ram and reciprocally moved in the pressure forming chamber, and the block member is configured so that the press forming die is replaceable with respect to the distal end of the press ram in a state where only the block member is lifted up.

2. The metal scrap compressor according to claim 1, wherein the press cylinder device includes the cylinder tube, the cylinder flange fixed to the end of the cylinder tube, the piston rod movably connected to the cylinder flange, the press ram fixed to the distal end of the piston rod and reciprocally moved together with the piston rod in the pressure forming chamber, and the press forming die replaceably mounted to the distal end of the press ram, and the pair of wall side blocks extends between the cylinder flange and the base stand to connect side portions of the cylinder flange and side portions of the base stand, and the block member is disposed on the base stand between the pair of wall side blocks to form an open space above the block member, and the piston rod reciprocally moves between the base stand and the cylinder tube through the open space.

3. The metal scrap compressor according to claim 2, wherein the block member further includes tie rods arranged at side portions of the block member and penetrating through the block member to fix the block member to the base stand.

4. The metal scrap compressor according to claim 3, further comprising another press forming die to be replaced with the press forming die, wherein the block member is arranged such that when the another press forming die is replaced with the press forming die, the tie rods are unfasten to release the block member from the base stand and the block member is lifted up to remove the press forming die, and the another press forming dies is replaced with the press forming die without removing the pair of wall side blocks from the base stand and the cylinder flange.

* * * * *